US005906161A

United States Patent [19]

Kessler

[11] Patent Number: 5,906,161

[45] Date of Patent: May 25, 1999

[54] INK ROLLER ASSEMBLY

[75] Inventor: John R. Kessler, Dayton, Ohio

[73] Assignee: Monarch Marking Systems, Inc., Dayton, Ohio

[21] Appl. No.: 08/988,256

[22] Filed: Dec. 10, 1997

[51] Int. Cl.[6] ..... B41F 31/00

[52] U.S. Cl. ..... 101/351.7; 101/352.1

[58] Field of Search ..... 101/349.1, 351.7, 101/352.1, 352.11, 352.12, 352.13, 348; 400/202.4, 200

[56] References Cited

U.S. PATENT DOCUMENTS

| | | | |
|---|---|---|---|
| 1,281,003 | 10/1918 | Henderson | 101/348 |
| 3,738,269 | 6/1973 | Wagner . | |
| 3,783,083 | 1/1974 | Jenkins . | |
| 3,957,562 | 5/1976 | Williams et al. . | |
| 4,246,842 | 1/1981 | Williams et al. . | |
| 4,399,751 | 8/1983 | Kessler . | |
| 4,416,201 | 11/1983 | Kessler . | |
| 5,190,385 | 3/1993 | Taguchi et al. | 400/200 |

FOREIGN PATENT DOCUMENTS

| | | |
|---|---|---|
| 0825121 | 2/1998 | European Pat. Off. . |

*Primary Examiner*—Edgar Burr
*Assistant Examiner*—Amanda B. Sandusky
*Attorney, Agent, or Firm*—Joseph J. Grass

[57] ABSTRACT

Disclosed are various embodiments of an ink roller assembly with a capillary ink metering unit and a surrounding porous ink retaining sleeve, wherein the unit is comprised of a pair of capillary sections connected to each other and wherein capillary sections include a hollow shaft and discs with intervening ink capillary chambers interconnected by passages. In another embodiment, a capillary ink metering unit includes discs on a solid shaft, wherein there are passages interconnecting capillary chambers.

8 Claims, 3 Drawing Sheets

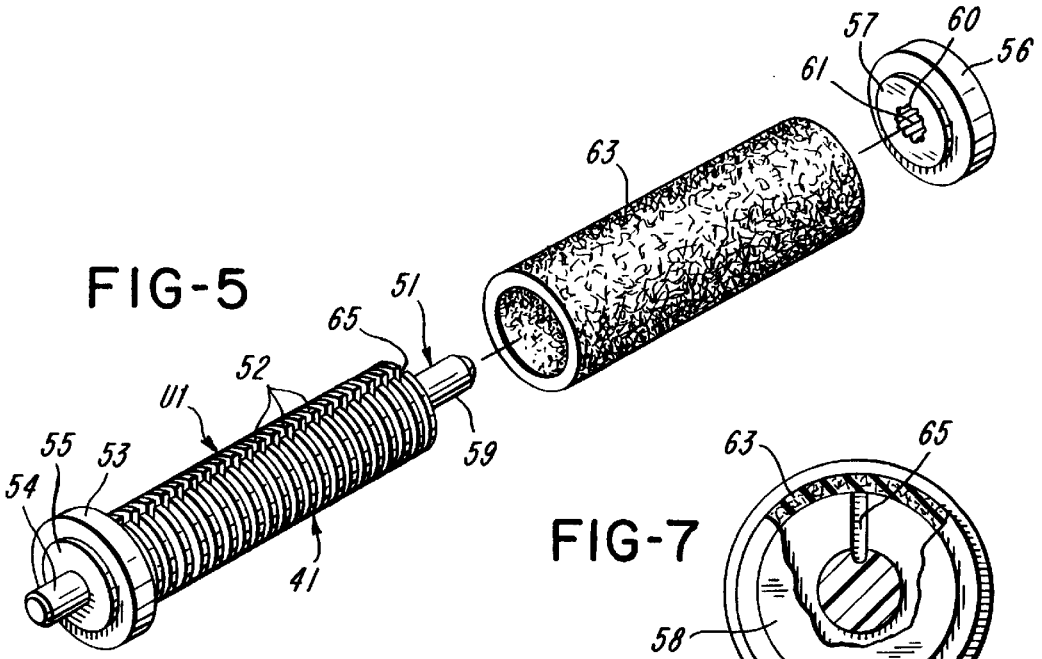
FIG-5
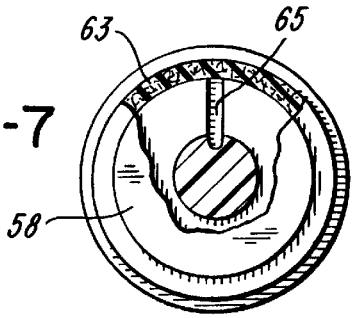
FIG-7
FIG-6
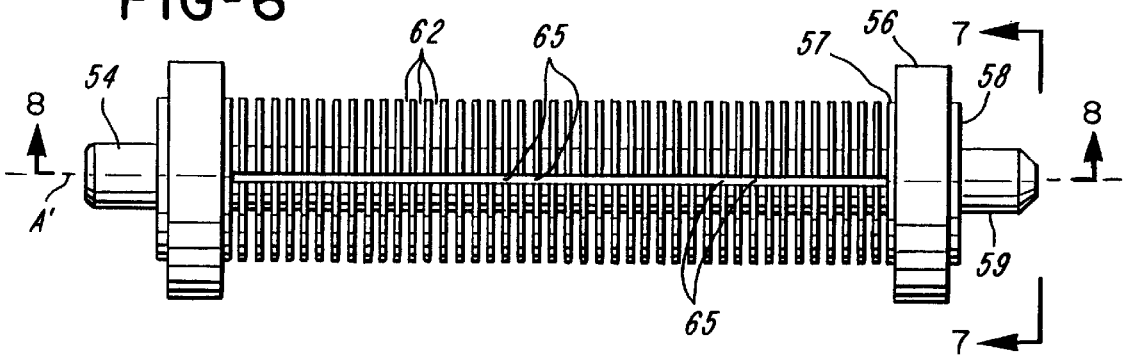
FIG-8
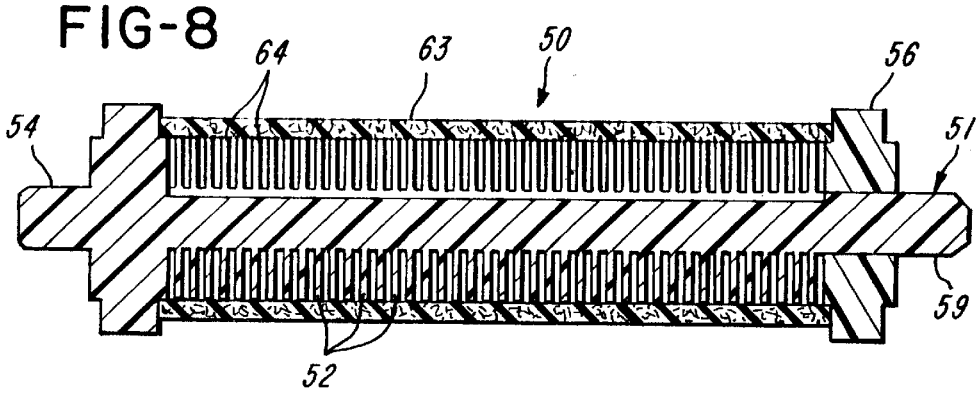

INK ROLLER ASSEMBLY

BACKGROUND OF THE INVENTION

1. Field of the Invention

This invention relates to the art of ink roller assemblies.

2. Brief Description of the Prior Art

The following are made of record: U.S. Pat. No. 3,738,269 to W. T. Wagner; U.S. Pat. No. 3,783,083 to W. A. Jenkins; U.S. Pat. No. 3,957,562 to P. H. Hamisch, Jr.; U.S. Pat. No. 4,246,842 to L. E. Williams et al; U.S. Pat. No. 4,399,751 to J. R. Kessler; U.S. Pat. No. 4,416,201 to J. R. Kessler; and U.S. patent application Ser. No. 08/701,259, filed Aug. 22, 1996 to J. D. Mistyurik et al.

SUMMARY OF THE INVENTION

The invention relates to improved ink rollers for providing a uniform application of ink over an extended use.

In one embodiment of the invention, the invention provides an ink roller assembly which can be rotatably mounted on an inker shaft of an inking device. The ink roller has first and second capillary sections connected to each other by a connector. Each of the first and second capillary sections has a flange, a hollow shaft and a series of closely spaced discs which provide capillary chambers for retaining ink. The first capillary section further includes a flexible resilient spring finger for releasably holding the ink roller on the inker shaft. There are preferably passages through the discs which allow for some flow of ink and pressure equalization. The hollow shafts of the first and second capillary sections have aligned openings for a receiving the inker shaft. The inker shaft has an annular groove for receiving the spring finger. There is a flexible resilient porous sleeve of ink retaining material in contact with and spanning the outer peripheries of the discs of both the first and second hub sections.

In another embodiment of the invention, a capillary section includes a series of closely spaced discs which provide capillary chambers for retaining ink. Passages interconnect the chambers to provide for some flow of ink and pressure equalization. A flange is disposed between the discs and a stub end. A. flexible resilient porous sleeve of ink retaining material is in contact with the outer peripheries of the discs.

In both embodiments, varying the peripheral configurations of the discs can enhance the distribution of ink to the outer surface of the sleeve of ink retaining material.

BRIEF DESCRIPTION OF THE DRAWINGS

FIG. 5 is an exploded perspective view of an ink roller assembly in accordance with another embodiment of the invention;

FIG. 6 is a top plan view of the ink roller assembly of FIG. 5, but omitting the sleeve;

FIG. 7 is a partly broken away end elevational view taken along line 7—7 of FIG. 6;

FIG. 8 is a vertical sectional view of the ink roller assembly taken along line 8—8 of FIG. 6;

DETAILED DESCRIPTION OF THE PREFERRED EMBODIMENTS

Figure 1:
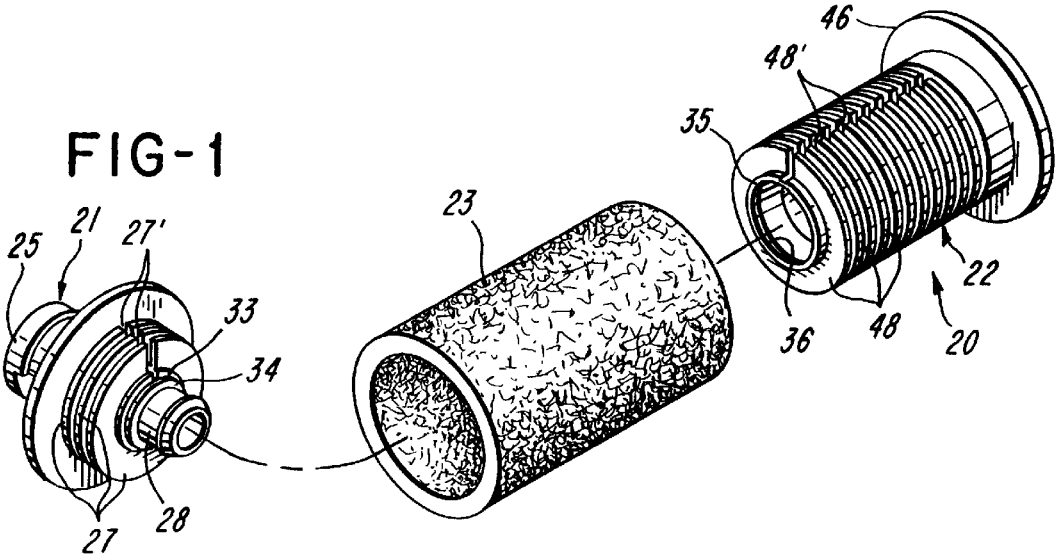
FIG. 1 is a rotated exploded perspective view of an ink roller assembly in accordance with one embodiment of the invention.
Figure 2:
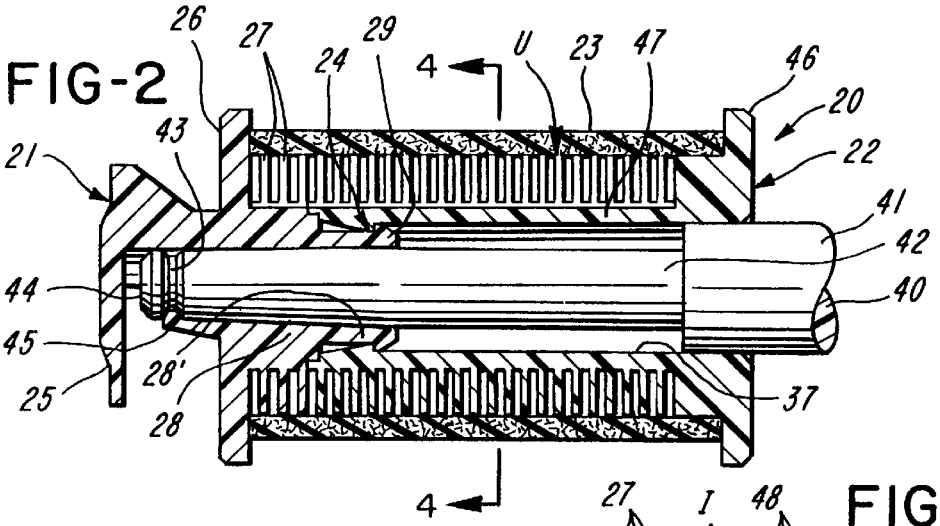
FIG. 2 is an assembled mainly sectional view of the ink roller assembly of FIG. 1 mounted on an inker shaft of an inking mechanism.
Figure 3:
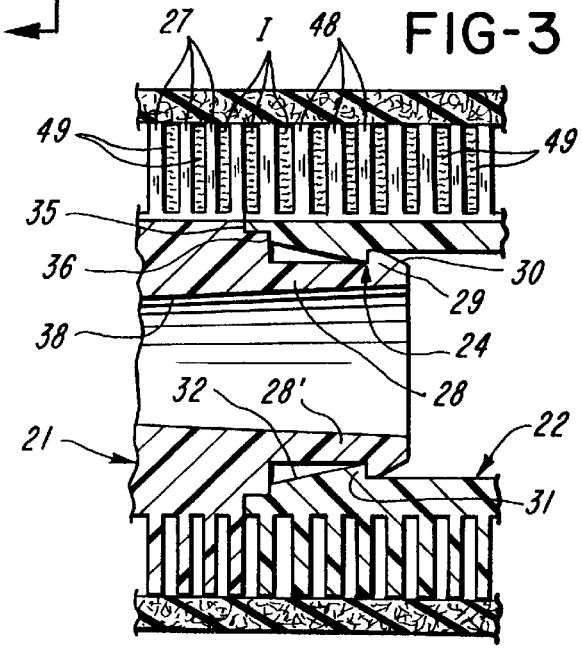
FIG. 3 is an enlarged fragmentary sectional view of a portion of the ink roller assembly shown in FIGS. 1 and 2.
Figure 4:
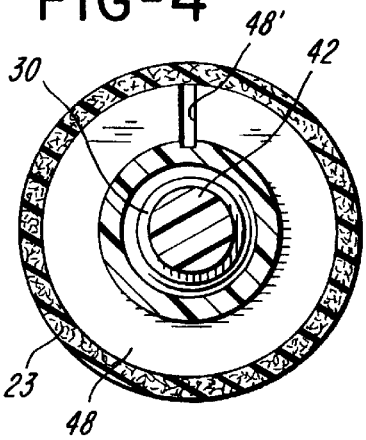
FIG. 4 is a sectional view taken along line 4—4 of FIG. 2.

Referring to the embodiment of FIG. 1 through 4, there is shown an ink roller assembly generally indicated at 20. The assembly is shown to include a first capillary section 21, a second capillary section 22 and a porous ink retaining sleeve 23. The capillary section 21 is connected to the capillary section 22 by a connector generally at 24. The capillary sections 21 and 22 provides a capillary ink metering unit U. The capillary section 21 has a handle 25, a flange or bearing roll 26, a series of closely spaced discs 27 and a shaft portion 28 with a connector portion 28'. The shaft portion 28 has a tapered bore 38. The connector portion 28' of the connector 24 is annular and has an annular external bead or tooth 29 with a lead-in or taper 30. The capillary section 22 has an annular internal bead or tooth 31 and a lead-in or taper 32. The capillary section 21 also has two abutment faces 33 and 34 which cooperate with respective abutment faces 35 and 36 on the capillary section 22. The connector 24 is of the snap-type so that when the connector portion 28' is moved into bore or passage 37, the connector portion 28' snaps into a locked position with the annular bead 31. In the locked position, the abutment faces 33 and 35, and 34 and 36 abut each other. Because of this construction there is an ink-tight seal between ink I and the bore or passage 37 on the inside of the hub section 22. Thus, ink I will not migrate onto grooved inker shaft 40 of an inking mechanism (not shown) but shown in U.S. application Ser. No. 08/701,259 filed Aug. 22, 1996, incorporated herein by reference. The shaft 40 is shown to be stepped with a large diameter portion 41 and a small diameter portion 42. The small diameter portion 42 has an annular external groove 43 near its terminal end 44. The capillary section 21 has an integral flexible resilient spring finger 45 shown to be engaged in the groove 43. To insert an ink roller assembly 20 onto the shaft 40, the ink roller assembly 20 is slid onto the shaft 40 until the spring finger moves into the groove 43. To remove the ink-roller assembly 20, the user grasps the handle 25 and pulls the ink roller assembly 20 off the shaft 40.

The capillary section 22 has a flange 46 and a hollow shaft portion 47 with a series of outwardly extending closely spaced discs 48. The discs 27 and 48 provide a long series of capillary chambers 49 extending between the flanges 26 and 46. Supported by the discs 27 and 48 is the flexible resilient ink-retaining porous sleeve 23. The sleeve 23 is under hoop-tension and makes direct contact with and spans across the outer peripheries of the discs 27 and 48. Some of the capillary chambers 49 are on the capillary section 21, but a greater number of the capillary chambers 49 on the capillary section 22.

The capillary sections 21 and 22 have passages 27' and 48' through the discs 27 and 48 in the form of radical slots or cutouts. The passages 27' and 48' provide for some flow of ink between the passages and pressure equalization within and between the chambers 49.

With reference to FIG. 5, there is shown another embodiment of ink roller assembly generally indicated at 50. The assembly 50 is shown to include a shaft or shaft portion generally indicated at 51, closely spaced discs 52 on the shaft 51, a flange 53 on the shaft 51 and a stub end 54 which is a part of the shaft 51. The flange 53 has an integrally molded annular projection or shoulder 55. It is preferred that the shaft 51 and its stub end 54, the discs 52, the flange 53 and the shoulder 55 be of one-piece molded plastics construction and provide a capillary ink retaining unit U1. The flange 53 is disposed between the discs 52 and the stub end 54. A flange or disc 56 having opposed projections 57 and 58 is shown to have been press-fitted onto the shaft 51 in FIGS. 5 through 8. An end portion of the shaft 51 is considered to be a stub end 59. The flange 56 has an annular central hole 60 provided with straight flutes 61 which compress when the stub end is received in the hole 60. The flange 56 is likewise of one-piece molded plastics construction.

There is ink in capillary chambers 62 between the discs 52. A flexible resilient porous ink-retaining sleeve 63 is shown in FIG. 8 to be in contact with outer peripheries 64 of the discs 52. The sleeve 63 is in hoop tension. As shown, there are passages 65 between the discs 52. Each passage 65 is shown to be a radial through-cut or slot. The passages 65 are shown to be aligned in the axial direction. The shaft 51 is shown to have an axis A' and the discs 52 are coaxial with the axis A'. The passages 65 provide for equalization of the pressure between the capillary chambers 62 and also promote some flow of ink between adjacent chambers 62 and to the sleeve 63. This is beneficial both when charging the chambers 62 and the sleeve 63 with ink I and during use of the ink roller assembly 50.

The charging of the chambers 49, 62 or can be performed by placing the unit U or U1 and the respective sleeve 23, 63 or 75 in a vat of ink and drawing a vacuum; and this charging can be accomplished either when the unit U or U1 and the respective sleeve 23, 63 or 75 are apart or when they are assembled.

Figure 9:
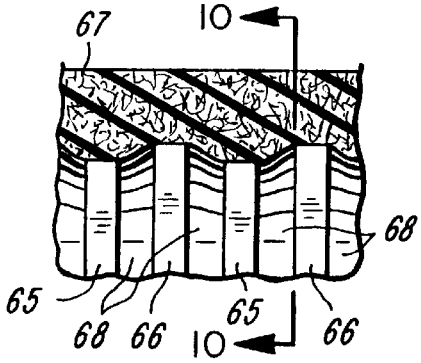
FIG. 9 is a fragmentary sectional view showing an alternative construction for the discs of the embodiments of FIGS. 1 through 8.
Figure 10:
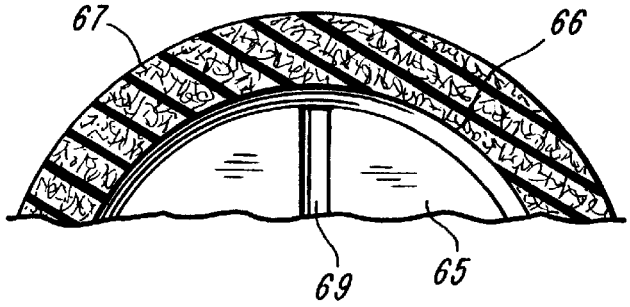
FIG. 10 is a sectional view taken along line 10—10 of FIG. 9.

With reference to FIGS. 9 and 10, there is shown an alternative form of discs 65 and 66. The discs 27, 49 and 52 can be modified as disclosed in FIGS. 9 and 10. The discs 65 and 66 have different outside diameters, with the discs 66 having a slightly larger diameter than the discs 65. A sleeve 67 is like the sleeves 23 and 63 in that it is under hoop tension and is ink receptive. The purpose of the different diameters is to promote the transference of ink from the capillary chambers 68 to the sleeve 67. There are aligned passages 69 through the discs 65 and 66 as shown in FIGS. 9 and 10. By way of example not limitation, the difference in the diameters of the discs 65 and 66 is on the order of 0.005 inch.

Figure 11:
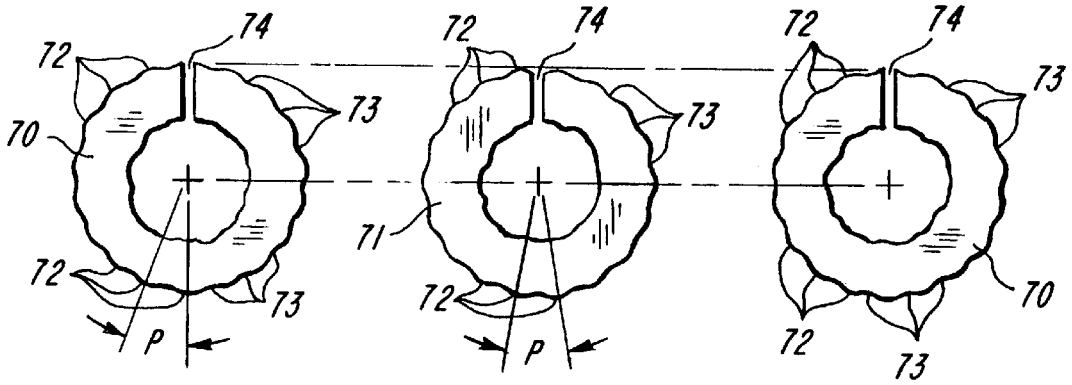
FIG. 11 is a developed fragmentary view showing another manner in which the discs of the embodiments of FIGS. 1 through 8 can be constructed.
Figure 12:
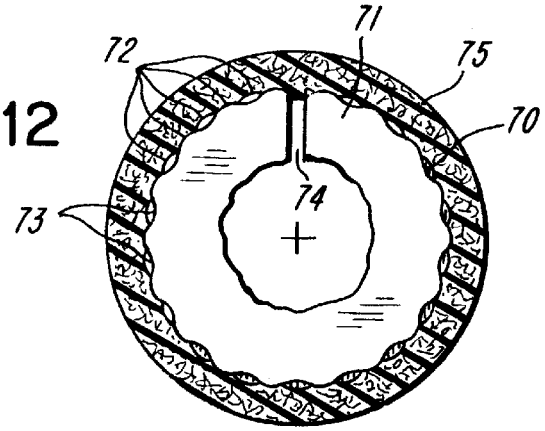
FIG. 12 is an assembled sectional fragmentary view of an alternative form of ink roller assembly.

FIG. 11 shows a developed view of a series of discs in which alternate discs 70 and 71 have undulating peripheries having high points 72 and low points 73. The discs 70 and 71 also have passages 74 like the passages 49 and 62. By way of example not limitation, the high points 72 have a pitch P of 20 degrees and consequently the low points also have a pitch of 20 degrees. Thus, there are eighteen high points and eighteen low points per disc. Every other disc 70 and 72 is offset as illustrated in FIGS. 11 and 12. FIG. 11 shows the high points 72 of the discs 70 aligned, and out of alignment with the high point 72 of the disc 71. The provision of discs with a variable peripheral edge configuration as shown in FIGS. 11 and 12 is applicable to both the embodiment of FIGS. 1 through 4 and the embodiment of FIGS. 5 through 8. Such variable edge configurations promote flow of ink from capillary passages 74 to the porous sleeve 75.

By way of example, not limitation, it is preferred that the spacing between the discs of the above disclosed embodiments be less than 0.02 inch and most preferably about 0.016 inch. The passages 27', 48', 65 and 74 are about 0.006 inch in width and extend from the shaft to the outer peripheries of the discs 27, 48, 52, 70 and 71. The discs 27, 48, 52, 70 and 71 are preferably about 0.012 inch in thickness.

Other embodiments and modifications of the invention will suggest themselves to those skilled in the art, and all such of these as come within the spirit of this invention are included within its scope as best defined by the appended claims.

I claim:

1. A ink roller assembly adapted to provide a uniform application of ink over an extended period of use, comprising a capillary ink metering and reservoir unit including a shaft and a series of discs on the shaft, the discs being closely axially spaced to provide capillary chambers, the discs having outer peripheries, a flexible resilient porous sleeve of ink retaining material in contact with the outer peripheries of the discs, ink in the capillary chambers and in the ink retaining material, and interconnecting passages between the chambers through the discs and extending generally in the axial direction.

2. An ink roller assembly as defined in claim 1, wherein the radial extents of adjacent discs vary.

3. An ink roller assembly as defined in claim 1, wherein the diameters of adjacent discs differ in an alternating pattern.

4. An ink roll as defined in claim 1, wherein the outer peripheries of the discs vary in an undulating pattern.

5. An ink roller assembly as defined in claim 1, wherein the outer peripheries of the discs vary in an undulating pattern, and wherein the patterns are staggered.

6. An ink roller assembly as defined in claim 5, wherein the patterns are alternately staggered.

7. An ink roller assembly as defined in claim 1, wherein the interconnecting passages are aligned.

8. An ink roller assembly adapted to provide a uniform application of ink over an extended use, comprising connected first and second capillary sections, each of the first and second capillary sections including a flange, a hollow shaft and a series of discs, the first hub section further including a flexible resilient spring finger, the discs of the capillary sections being disposed between the flanges, the hollow shafts of the first and second capillary sections having openings for a mounting shaft with an annular groove for receiving the spring finger, the discs of the first and second capillary sections being closely spaced to provide capillary chambers, the discs having outer peripheries, a flexible resilient porous sleeve of ink retaining material in contact with and spanning the outer peripheries of the discs of both the first and second capillary sections, and wherein the diameters of adjacent discs differ in an alternating pattern.

* * * * *

UNITED STATES PATENT AND TRADEMARK OFFICE

CERTIFICATE OF CORRECTION

PATENT NO. : 5,906,161

DATED : May 25, 1999

INVENTOR(S) : John R. Kessler

It is certified that error appears in the above-indentified patent and that said Letters Patent is hereby corrected as shown below:

Cover Sheet, Refs. Cited, after 3,957,562 5/1976, "Williams et al" should be --Hamisch, Jr.--. Column 3, line 36, after "or" --74-- should be added.

Signed and Sealed this

Eleventh Day of April, 2000

*Attest:*

*Attesting Officer*

Q. TODD DICKINSON

*Director of Patents and Trademarks*